US006367584B1

(12) United States Patent
Edwards

(10) Patent No.: US 6,367,584 B1
(45) Date of Patent: Apr. 9, 2002

(54) LADDER FOR ABOVE-GROUND POOLS WITH INCORPORATED FOOT RINSING SYSTEM

(76) Inventor: Robert Edwards, 40 Bailey Ave., Patchogue, NY (US) 11772

( * ) Notice: Subject to any disclaimer, the term of this patent is extended or adjusted under 35 U.S.C. 154(b) by 0 days.

(21) Appl. No.: 09/779,563

(22) Filed: Feb. 9, 2001

(51) Int. Cl.[7] ..... E06C 5/32

(52) U.S. Cl. ..... 182/93; 182/129; 182/18; 4/615; 4/492

(58) Field of Search ..... 182/93, 129, 18; 4/494, 492, 615, 622; 248/77, 78; 472/117

(56) References Cited

U.S. PATENT DOCUMENTS

| | | | | | |
|---|---|---|---|---|---|
| 724,953 | A | * | 4/1903 | Schaller | |
| 3,090,489 | A | * | 5/1963 | Smith | 182/93 |
| 3,925,830 | A | * | 12/1975 | Delaney | 4/615 |
| 4,193,143 | A | * | 3/1980 | Vianna | |
| 4,268,386 | A | * | 5/1981 | May | |
| D265,251 | S | | 6/1982 | Darby et al. | D25/64 |
| 4,342,125 | A | * | 8/1982 | Hodge | |
| 4,579,197 | A | | 4/1986 | Spurling | 182/106 |
| 5,056,167 | A | * | 10/1991 | Cholley | 4/492 |
| 5,954,154 | A | | 9/1999 | Ziolkowski | 182/129 |

* cited by examiner

*Primary Examiner*—Alvin Chin-Shue
(74) *Attorney, Agent, or Firm*—Goldstein Law Offices, PC

(57) ABSTRACT

A ladder for aboveground pools with incorporated foot rinsing system including a ladder portion adapted for coupling with a swimming pool. The ladder portion is comprised of a pair of elongated vertical spaced apart rails. The ladder portion includes a plurality of horizontal steps extending between the pair of rails in a spaced relationship. A water tank is secured to one of the pair of elongated vertical spaced apart rails of the ladder portion. The water tank has a hollow interior for holding a quantity of water therein. A plurality of water nozzles are secured within one of the pair of elongated vertical spaced apart rails of the ladder portion in a spaced relationship. The water nozzles are directed downwardly toward the horizontal steps of the ladder portion. The water nozzles are connected with the hollow interior of the water tank for receiving water therefrom.

5 Claims, 2 Drawing Sheets

LADDER FOR ABOVE-GROUND POOLS WITH INCORPORATED FOOT RINSING SYSTEM

BACKGROUND OF THE INVENTION

The present invention relates to a ladder for above-ground pools with incorporated foot rinsing system and more particularly pertains to cleaning a persons feet prior to entering the above-ground pool.

People who have pools, particularly above-ground pools, utilize a ladder to gain access to the pool. Typically, these pools are positioned on a homeowners property surrounded by a grassy or sandy area. Thus, in order to enter the pool, people must traverse these areas to reach the ladder to go into the pool. Unfortunately, once people reach the ladder and pool, their feet are covered with grass and/or sand. The grass and/or sand must either be rinsed off prior to entering the pool or the person will enter the pool causing the grass and sand to be rinsed off in the pool. The latter, leaves the pool in a dirty condition. Other options include separate basins of water that a person can rinse their feet in prior to entering the pool. Ultimately, this basin must be emptied, cleaned, and refilled with new water. What is needed is a way for people to easily wash their feet prior to entering a swimming pool.

The present invention attempts to solve the abovementioned problem by providing a rinsing system incorporated in a pool entry ladder that will automatically rinse a person's feet prior to them entering the pool.

The use of ladder accessory devices is known in the prior art. More specifically, ladder accessory devices heretofore devised and utilized for the purpose of facilitating the use of ladders are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,579,197 to Spurling discloses a shield for a swimming pool ladder to prevent toddlers from climbing the steps. U.S. Pat. No. Des. 265,251 to Darby discloses the ornamental design for a swimming pool ladder. U.S. Pat. No. 5,954,154 to Ziolkowski discloses a ladder with an indicator for the bottom step.

While these devices fulfill their respective, particular objective and requirements, the aforementioned patents do not describe a ladder for aboveground pools with incorporated foot rinsing system for cleaning a persons' foot before entering the aboveground pool.

In this respect, the ladder for aboveground pools with incorporated foot rinsing system according to the present invention substantially departs from the conventional concepts and designs of the prior art, and in doing so provides an apparatus primarily developed for cleaning some persons feet before entering the aboveground pool.

Therefore, it can be appreciated that there exists a continuing need for a new and improved ladder for aboveground pools with incorporated foot rinsing system that can be used for cleaning some persons feet before entering the aboveground pool. In this regard, the present invention substantially fulfills this need.

SUMMARY OF THE INVENTION

In the view of the foregoing disadvantages inherent in the known types of ladder accessory devices now present in the prior art, the present invention provides an improved ladder for aboveground pools with incorporated foot rinsing system. As such, the general purpose of the present invention, which will be described subsequently in greater detail, is to provide a new and improved ladder for aboveground pools with incorporated foot rinsing system that has all the advantages of the prior art and none of the disadvantages.

To attain this, the present invention essentially comprises a ladder portion adapted for coupling with an upper edge of an aboveground swimming pool. The ladder portion comprises a pair of elongated vertical spaced apart rails. The ladder portion includes a plurality of horizontal steps extending between the pair of rails in a spaced relationship. A water tank is secured to one of the pair of elongated vertical spaced apart rails of the ladder portion. The water tank has a hollow interior for holding a quantity of water therein. The water tank has a hose connection in communication with the hollow interior for coupling with a standard water hose. A plurality of water nozzles is secured within one of the pair of elongated vertical spaced apart rails of the ladder portion in a spaced relationship. The water nozzles are directed downwardly toward the horizontal steps of the ladder portion. The water nozzles are connected with the hollow interior of the water tank for receiving water therefrom. A plurality of sensors is secured to one of the pair of elongated vertical spaced apart rails of the ladder portion. The plurality of sensors is in communication with the plurality of water nozzles for the activation thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ladder for aboveground pools with incorporated foot rinsing system that has all the advantages of the prior art ladder accessory devices and none of the disadvantages.

It is another object of the present invention to provide a new and improved ladder for aboveground pools with incorporated foot rinsing system that may be easily and efficiently manufactured and marketed.

It is a further object of the present invention to provide a new and improved ladder for aboveground pools with incorporated foot rinsing system that is of durable and reliable construction.

An even further object of the present invention is to provide a new and improved ladder for aboveground pools with incorporated foot rinsing system that is susceptible of a low cost of manufacture with regard to both materials and labor, and which accordingly is then susceptible of low prices of sale to the consuming public, thereby making such a ladder for aboveground pools with incorporated foot rinsing system economically available to the buying public.

Even still another object of the present invention is to provide a new and improved ladder for aboveground pools with incorporated foot rinsing system for cleaning a persons feet before entering the aboveground pool.

Lastly, it is an object of the present invention to provide a new and improved ladder for aboveground pools with incorporated foot rinsing system including a ladder portion adapted for coupling with a swimming pool. The ladder portion comprises a pair of elongated vertical spaced apart rails. The ladder portion includes a plurality of horizontal steps extending between the pair of rails in a spaced relationship. A water tank is secured to one of the pair of elongated vertical spaced apart rails of the ladder portion. The water tank has a hollow interior for holding a quantity of water therein. A plurality of water nozzles are secured within one of the pair of elongated vertical spaced apart rails of the ladder portion in a spaced relationship. The water nozzles are directed downwardly toward the horizontal steps of the ladder portion. The water nozzles are connected with the hollow interior of the water tank for receiving water therefrom.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to figures one through two thereof, the preferred embodiment of the new and improved ladder for aboveground pools with incorporated foot rinsing system embodying the principles and concepts of the present invention and generally designated by the reference number 10 will be described.

Specifically, it will be noted in the various figures that the device relates to a ladder for aboveground pools with incorporated foot rinsing system for cleaning a persons feet before entering the aboveground pool. In its broadest context, the device consists of a ladder portion, a water tank, a plurality of water nozzles, and a plurality of sensors. Such components are individually configured and correlated with respect to each other so as to attain the desired objective.

Figure 1:
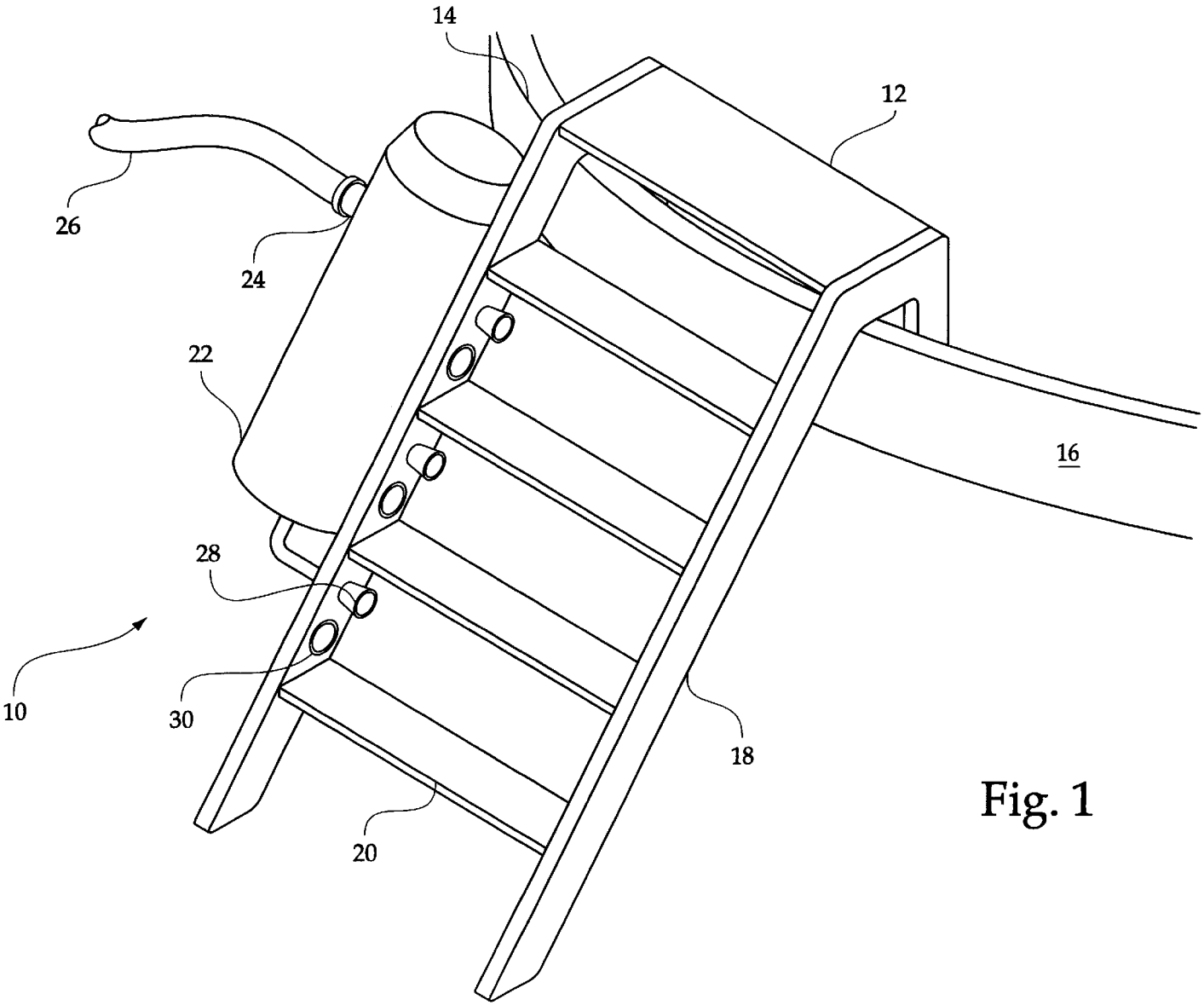
FIG. 1 is a perspective view of the preferred embodiment of the ladder for aboveground pools with incorporated foot rinsing system constructed in accordance with the principles of the present invention.
Figure 2:
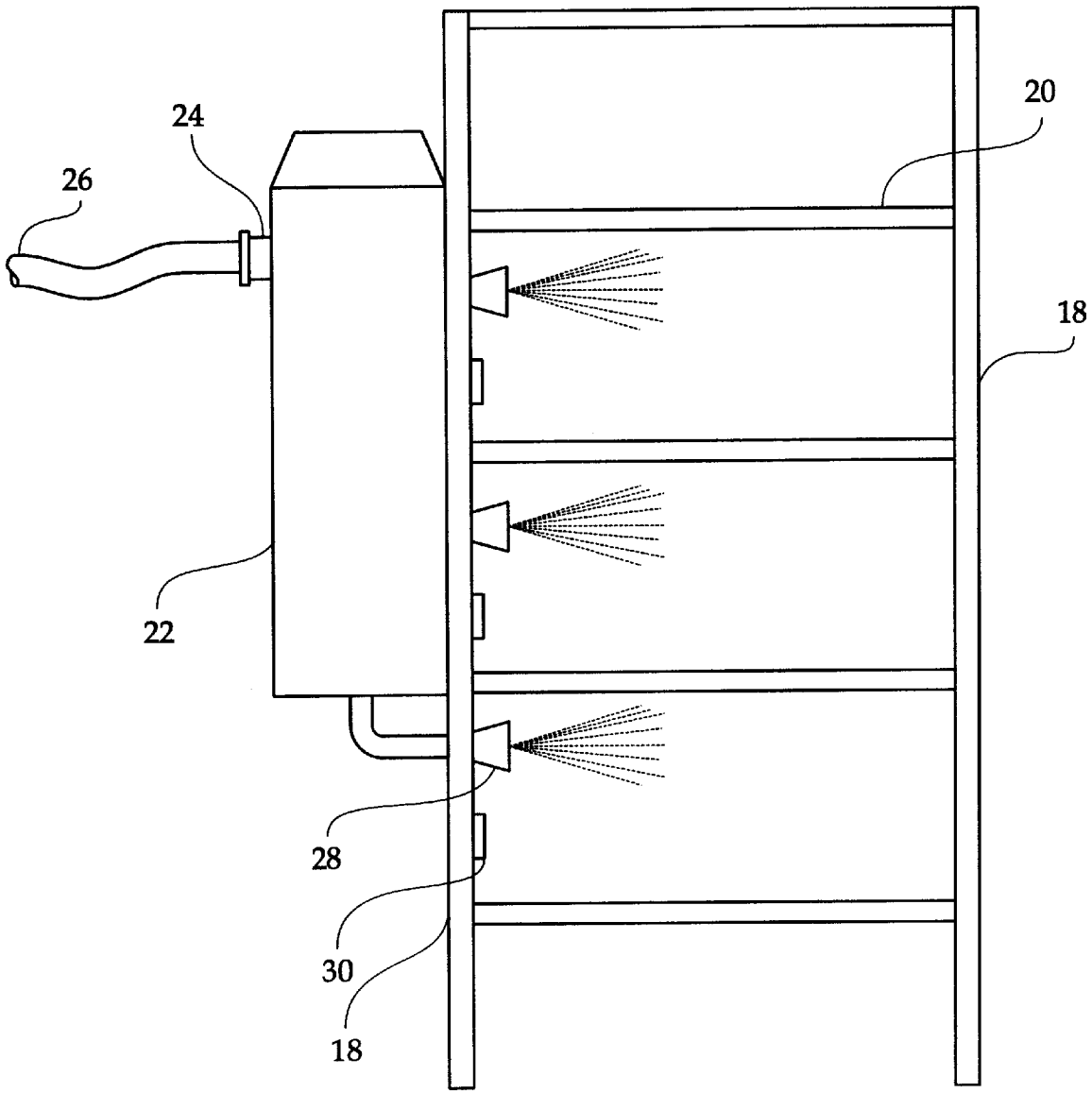
FIG. 2 is a front view of the present invention.

The ladder portion 12 is adapted for coupling with an upper edge 14 of an aboveground swimming pool 16. Note FIG. 1. The ladder portion 12 comprises a pair of elongated vertical spaced apart rails 18. The ladder portion 12 includes a plurality of horizontal steps 20 extending between the pair of rails 18 in a spaced relationship.

The water tank 22 is secured to one of the pair of elongated vertical spaced apart rails 18 of the ladder portion 12. Preferably, the water tank 22 is secured to an outer surface of the rail 18. The water tank 22 has a hollow interior for holding a quantity of water therein. The size of the tank 22 can be varied according to the needs of the end user. The water tank 22 has a hose connection 24 in communication with the hollow interior for coupling with a standard water hose 26. This will allow the water tank 22 to be provided with a continuous flow of water as long as the water hose 26 is connected to a running water source. Alternately, the water tank 22 can be provided with an openable upper end to allow water to be added thereto.

The plurality of water nozzles 28 are secured within one of the pair of elongated vertical spaced apart rails 18 of the ladder portion 12 in a spaced relationship. The water nozzles 28 are directed downwardly toward the horizontal steps 20 of the ladder portion 12. The water nozzles 28 are connected with the hollow interior of the water tank 22 for receiving water therefrom. The water nozzles 28 can be adjustable, in terms of the amount of water pressure or the amount of water dispensed. The downward direction of the nozzles 28 will allow water to be directed on a foot positioned on one of the step's 20.

The plurality of sensors 30 are secured to one of the pair of elongated vertical spaced apart rails 18 of the ladder portion 12. The plurality of sensors 30 are in communication with the plurality of water nozzles 28 for the activation thereof. The sensors 30 will also be directed toward the steps 20 of the ladder portion whereby a foot positioned on one of the steps 20 will be sensed, causing the water nozzle 28 for that step 20 to be activated for a predetermined period of time, or for as long as the foot is positioned on the step 20. Alternately, the senors 30 can be replaced by other means for activating the water nozzles 28. One example of such alternate means would be a pressure plate positioned on the step's 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder for aboveground pools with incorporated foot rinsing system for cleaning a persons feet before entering the aboveground pool comprising, in combination:

a ladder portion adapted for coupling with an upper edge of an aboveground swimming pool, the ladder portion being comprised of a pair of elongated vertical spaced apart rails, the ladder portion including a plurality of horizontal steps extending between the pair of rails in a spaced relationship;

a water tank secured to one of the pair of elongated vertical spaced apart rails of the ladder portion, the water tank having a hollow interior for holding a quantity of water therein, the water tank having a hose connection in communication with the hollow interior for coupling with a standard water hose;

a plurality of water nozzles secured within one of the pair of elongated vertical spaced apart rails of the ladder portion in a spaced relationship, the water nozzles being directed downwardly toward the horizontal steps of the ladder portion, the water nozzles being connected with the hollow interior of the water tank for receiving water therefrom; and a plurality of sensors secured to one of the pair of elongated vertical spaced apart rails of the ladder portion, the plurality of sensors being in communication with the plurality of water nozzles for the activation thereof.

2. A ladder for aboveground pools with incorporated foot rinsing system for cleaning a persons feet before entering the aboveground pool comprising, in combination:

a ladder portion adapted for coupling with a swimming pool, the ladder portion being comprised of a pair of elongated vertical spaced apart rails, the ladder portion including a plurality of horizontal steps extending between the pair of rails in a spaced relationship;

a water tank secured to one of the pair of elongated vertical spaced apart rails of the ladder portion, the water tank having a hollow interior for holding a quantity of water therein; and a plurality of water nozzles secured within one of the pair of elongated vertical spaced apart rails of the ladder portion in a spaced relationship, the water nozzles being directed downwardly toward the horizontal steps of the ladder portion, the water nozzles being connected with the hollow interior of the water tank for receiving water therefrom.

3. The ladder for aboveground pools with incorporated foot rinsing system as set forth in claim 2, wherein the water tank has a hose connection in communication with the hollow interior for coupling with a standard water hose.

4. The ladder for aboveground pools with incorporated foot rinsing system as set forth in claim 2, and further including activation means in communication with the plurality of water nozzles for the activation thereof.

5. The ladder for aboveground pools with incorporated foot rinsing system as set forth in claim 4, wherein the activation means are a plurality of sensors secured to one of the pair of elongated vertical spaced apart rails of the ladder portion.

* * * * *